US010486011B2

(12) United States Patent
McGuire et al.

(10) Patent No.: US 10,486,011 B2
(45) Date of Patent: Nov. 26, 2019

(54) WEIGHTLIFTING GLOVE AND HOOK ASSEMBLY

(71) Applicants: Leroy McGuire, Tarboro, NC (US); Marvin Harvey, Tarboro, NC (US)

(72) Inventors: Leroy McGuire, Tarboro, NC (US); Marvin Harvey, Tarboro, NC (US)

( * ) Notice: Subject to any disclaimer, the term of this patent is extended or adjusted under 35 U.S.C. 154(b) by 59 days.

(21) Appl. No.: 15/802,546

(22) Filed: Nov. 3, 2017

(65) Prior Publication Data

US 2019/0134453 A1 May 9, 2019

(51) Int. Cl.

| | |
|---|---|
| ***A63B 21/00*** | (2006.01) |
| ***A63B 71/14*** | (2006.01) |
| ***A41D 19/015*** | (2006.01) |
| ***A41D 19/00*** | (2006.01) |

(52) U.S. Cl.

CPC ..... *A63B 21/4019* (2015.10); *A41D 19/0024* (2013.01); *A41D 19/01547* (2013.01); *A41D 19/01594* (2013.01); *A63B 71/141* (2013.01)

(58) Field of Classification Search

CPC ..... A41D 19/0024; A41D 19/0037; A41D 19/0034; A41D 19/01547; A41D 19/01588; A41D 19/01594; A41D 13/082; A41D 13/085; A41D 13/087; A41D 19/01552; A41D 19/01582; A63B 21/4019; A63B 71/146; A63B 71/14; A63B 71/148; A63B 71/141; A63B 21/4021

USPC ..... 2/17, 20, 161.2, 160

See application file for complete search history.

(56) References Cited

U.S. PATENT DOCUMENTS

| | | | | | |
|---|---|---|---|---|---|
| 1,587,287 | A * | 6/1926 | Denman | A63B 53/14 | 473/205 |
| 1,692,201 | A * | 11/1928 | Denman | A63B 53/14 | 473/205 |
| 2,877,465 | A * | 3/1959 | Stroud | A63B 71/146 | 2/20 |
| 3,417,840 | A * | 12/1968 | Farnsworth, Jr. | A41D 19/01594 | 182/8 |
| 3,541,990 | A * | 11/1970 | Du Mas | B63B 35/817 | 441/69 |
| 4,487,412 | A * | 12/1984 | Meeko | A63B 21/4021 | 482/106 |
| 4,546,495 | A * | 10/1985 | Castillo | A41D 19/01523 | 2/161.1 |
| 4,684,122 | A | 8/1987 | Desmond et al. | | |
| 5,214,799 | A * | 6/1993 | Fabry | A41D 19/01523 | 2/161.6 |
| D351,933 | S * | 11/1994 | Stoneman | A63B 71/14 | 2/160 |
| 5,471,681 | A * | 12/1995 | Ferrini | A41D 19/01594 | 2/160 |

(Continued)

*Primary Examiner* — Amy Vanatta

(57) ABSTRACT

A weightlifting glove and hook assembly for supporting a weight while weight lifting includes a glove body that has a top end, a bottom end, a palm side, an outer surface and an inner surface. The top end and the bottom end are positioned on opposite ends of the glove body such that the glove body is positioned between the top end and the bottom end. A padding is attached to and covers the inner surface. The top end includes a plurality of finger sleeves. The bottom end has a cuff portion that is open for receiving a wrist. A support rod releasably engages two of the finger sleeves and extends forward of the palm side. The support rod has a receiving space to partially extend around a weightlifting bar.

5 Claims, 5 Drawing Sheets

(56) References Cited

U.S. PATENT DOCUMENTS

| | | | | |
|---|---|---|---|---|
| 5,704,845 | A * | 1/1998 | Boyte | A63B 69/3608 473/205 |
| 5,790,980 | A * | 8/1998 | Yewer, Jr. | A41D 19/01523 2/161.1 |
| D454,230 | S | 3/2002 | DeLaup | |
| 6,436,016 | B1 | 8/2002 | Valentino | |
| 7,000,258 | B1 * | 2/2006 | Nunally | A41D 19/01594 2/160 |
| 7,008,355 | B2 | 3/2006 | Emick | |
| 7,946,967 | B2 | 5/2011 | Berhanu | |
| 7,963,891 | B1 | 6/2011 | Zeaman | |
| 8,267,844 | B2 | 9/2012 | Kassel et al. | |
| 8,777,816 | B2 * | 7/2014 | Grafman | A63B 71/14 482/104 |
| 9,017,232 | B2 | 4/2015 | Olivarez et al. | |
| 2003/0154538 | A1 * | 8/2003 | Murphy | A63B 69/0066 2/161.1 |
| 2004/0250329 | A1 * | 12/2004 | Rickert | A45F 5/102 2/16 |
| 2017/0361184 | A1 * | 12/2017 | Roy | A63B 69/3608 |

* cited by examiner

WEIGHTLIFTING GLOVE AND HOOK ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to hook and glove combination devices and more particularly pertains to a new hook and glove combination device for supporting a weight while weightlifting.

BRIEF SUMMARY OF THE INVENTION

An embodiment of the disclosure meets the needs presented above by generally comprising a glove body that has a top end, a bottom end, a palm side, an outer surface and an inner surface. The top end and the bottom end are positioned on opposite ends of the glove body such that the glove body is positioned between the top end and the bottom end. A padding is attached to and covers the inner surface. The top end includes a plurality of finger sleeves. The bottom end has a cuff portion that is configured for receiving a wrist. A support rod releasably engages two of the finger sleeves and extends forward of the palm side. The support rod is configured to partially extend around a weightlifting bar.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
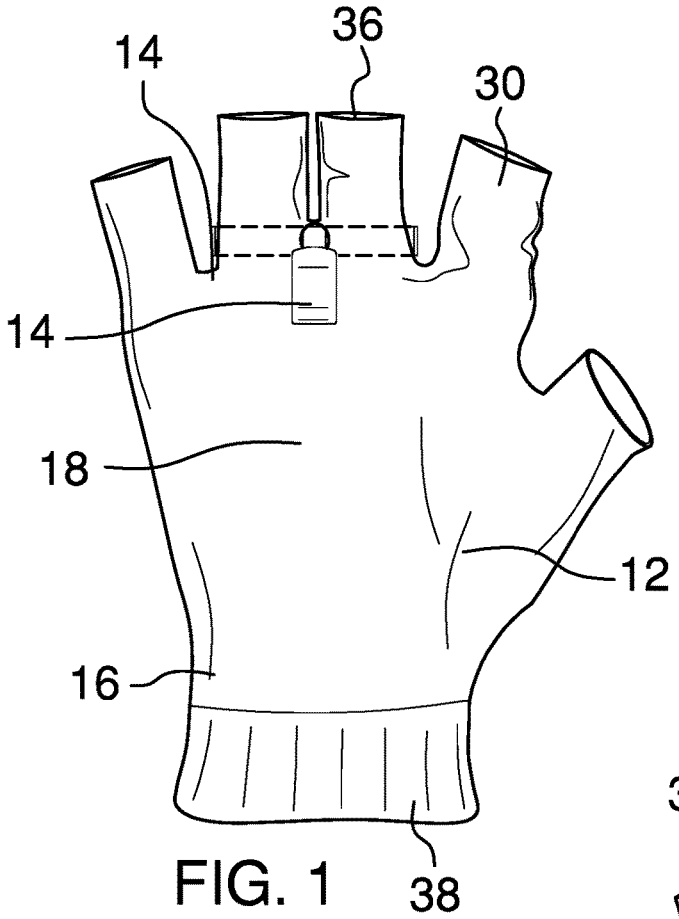
FIG. 1 is a front view of a weightlifting glove and hook assembly according to an embodiment of the disclosure.
Figure 2:
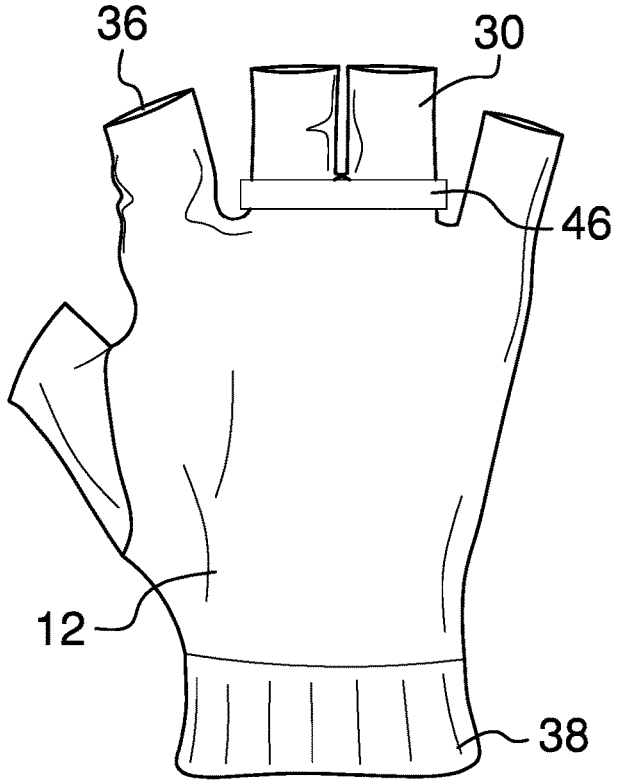
FIG. 2 is a back view of an embodiment of the disclosure.
Figure 3:
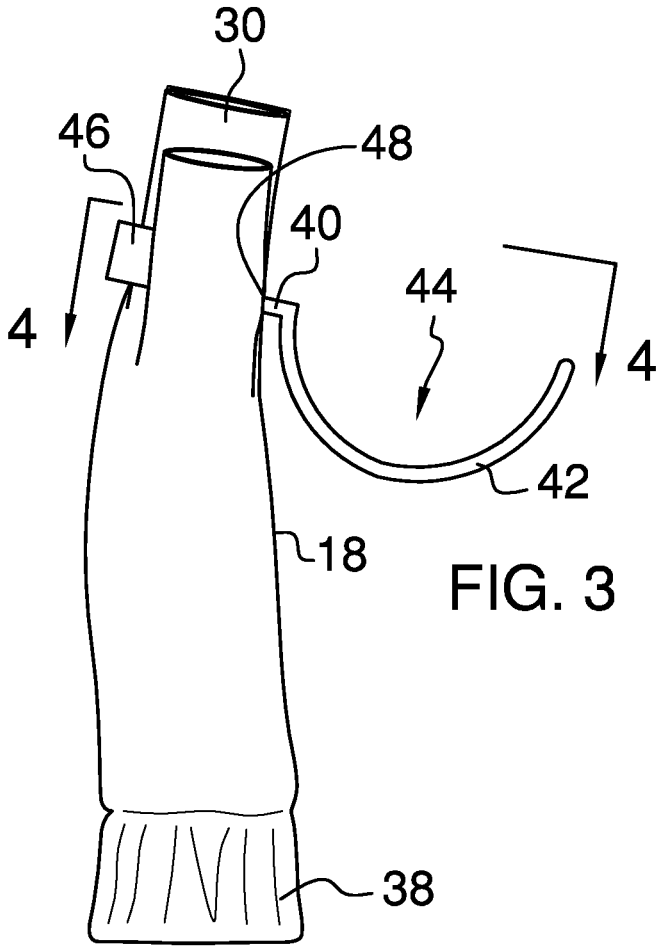
FIG. 3 is a side view of an embodiment of the disclosure.
Figure 4:
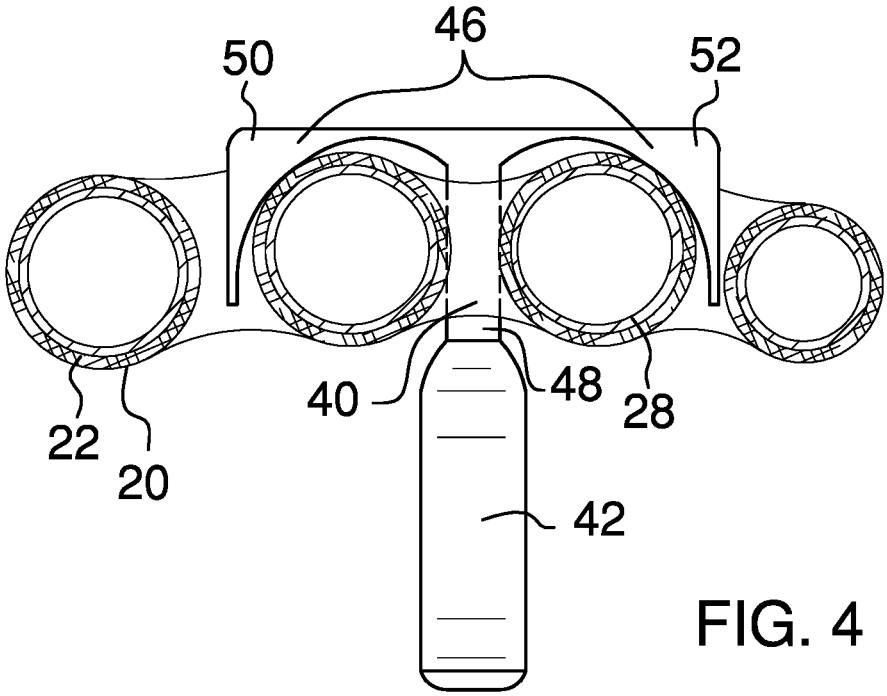
FIG. 4 is a cross-sectional view of an embodiment of the disclosure taken along line 4-4 of FIG. 3.
Figure 5:
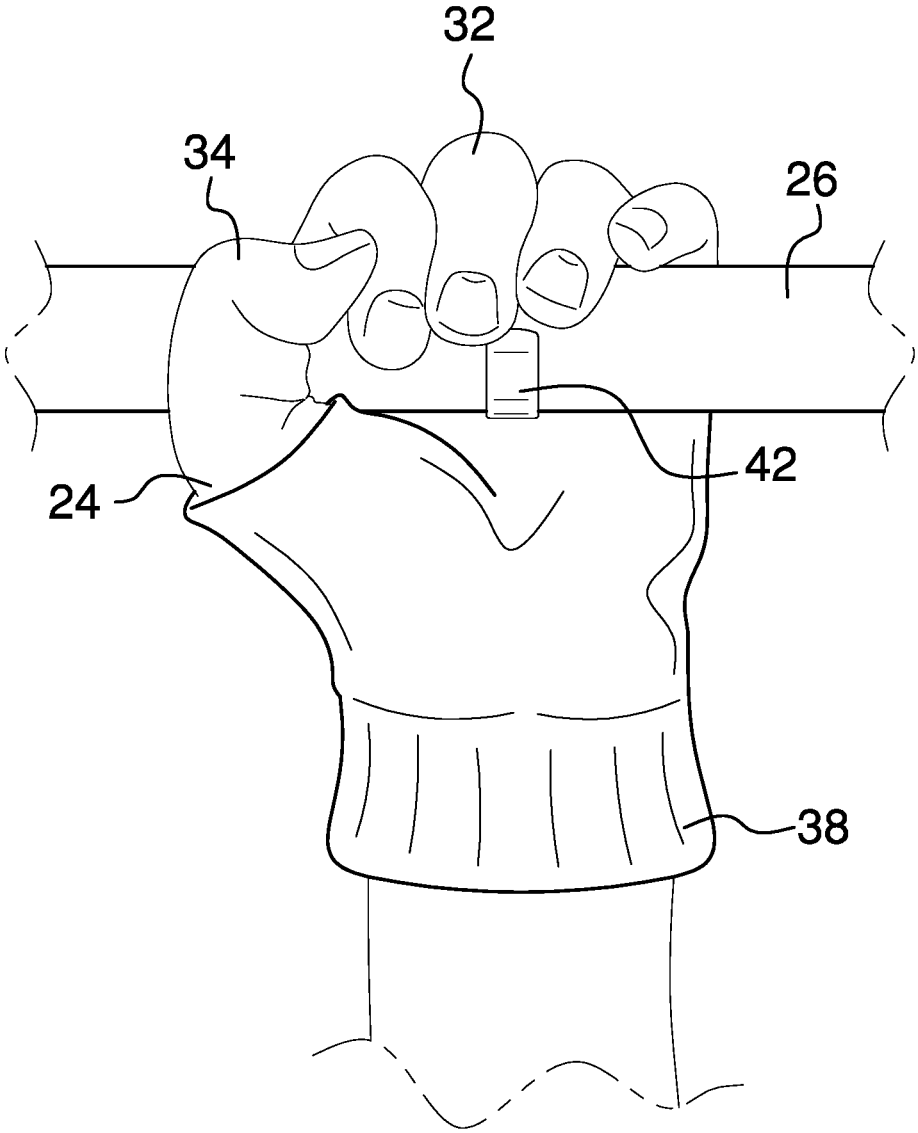
FIG. 5 is a front view of an embodiment of the disclosure.
Figure 6:
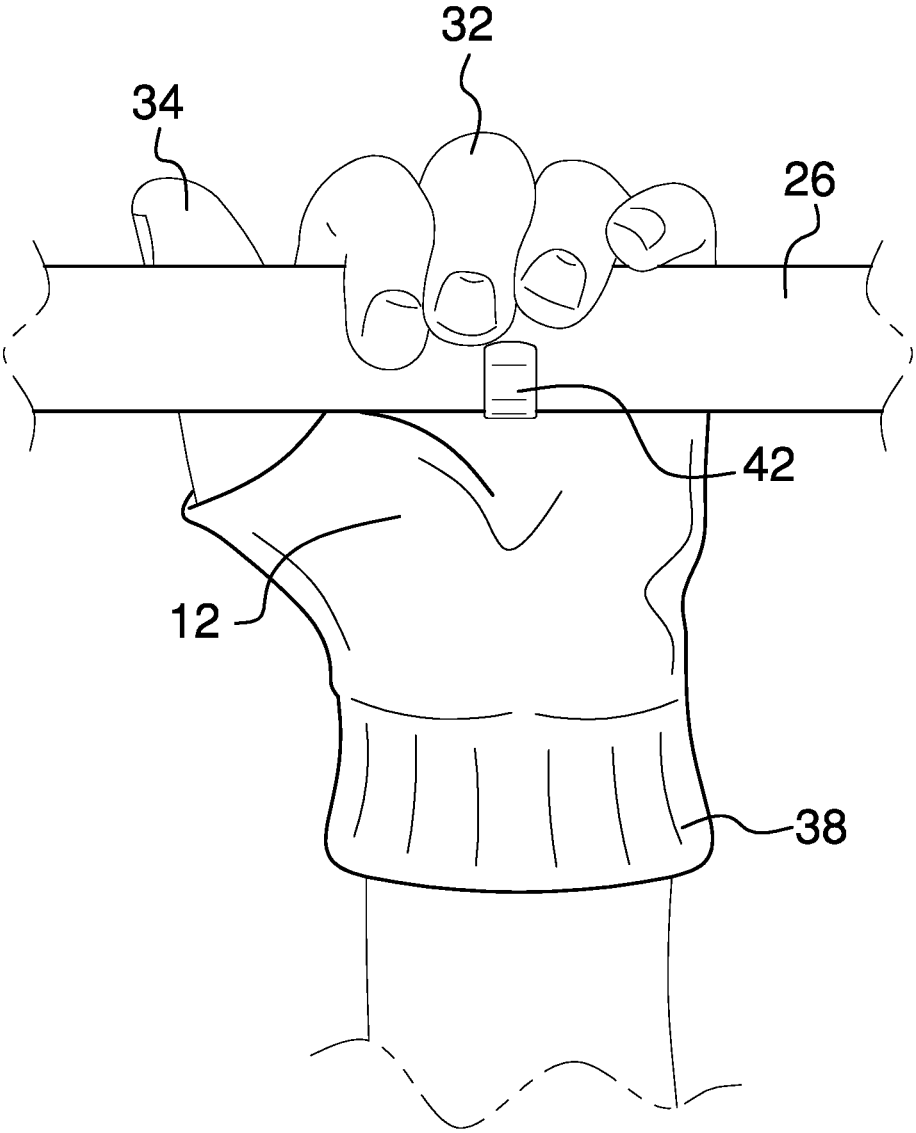
FIG. 6 is a front view of an embodiment of the disclosure.
Figure 7:
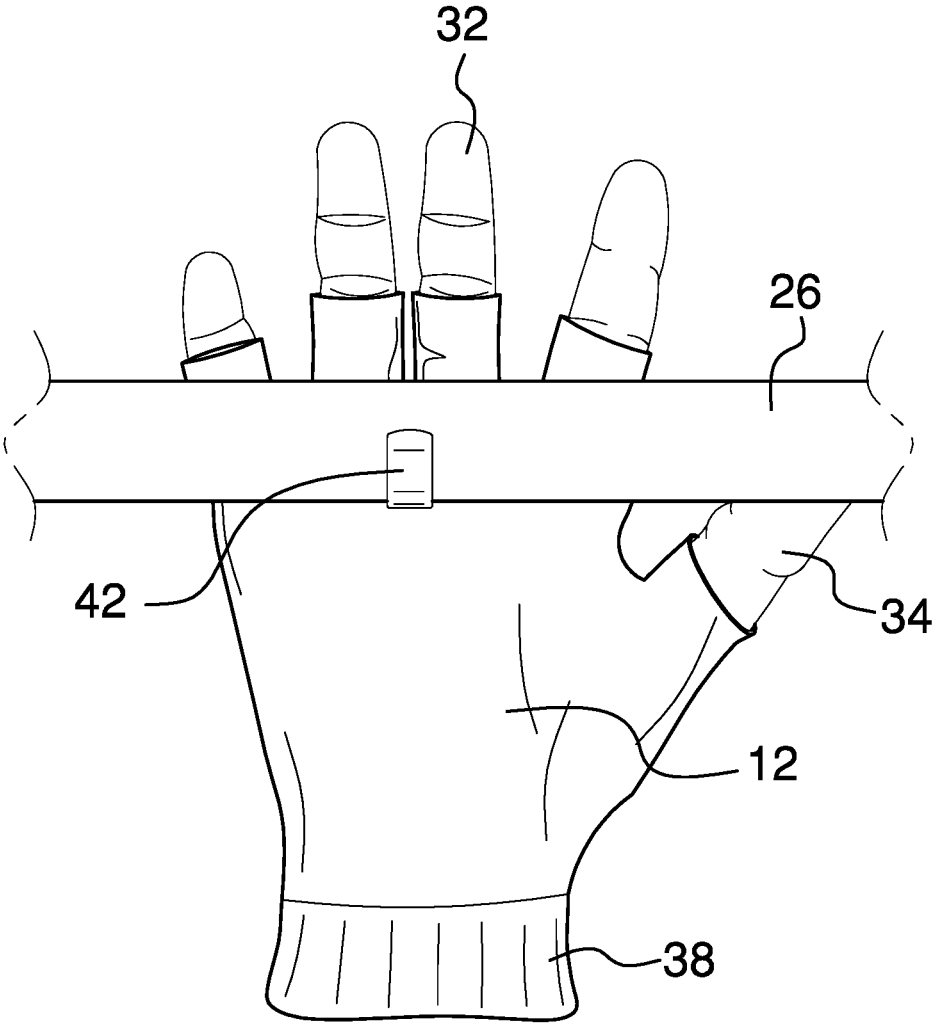
FIG. 7 is a front view of an embodiment of the disclosure.

With reference now to the drawings, and in particular to FIGS. 1 through 7 thereof, a new hook and glove combination device embodying the principles and concepts of an embodiment of the disclosure and generally designated by the reference numeral 10 will be described.

As best illustrated in FIGS. 1 through 7, the weightlifting glove and hook assembly 10 generally comprises a glove body 12 that has a top end 14, a bottom end 16, a palm side 18, an outer surface 20 and an inner surface 22. The top end 14 and the bottom end 16 are positioned on opposite ends of the glove body 12 such that the glove body 12 is positioned between the top end 14 and the bottom end 16. The glove body 12 may be comprised of leather, wool or any other material suitable for sheathing a hand 24 from a weightlifting bar 26. Padding 28 is attached to and covers the inner surface 22. The padding 28 comprises of a resiliently compressible material. The resiliently compressible material may be comprised of polyurethane or cotton but should be understood as any resiliently compressible material. The top end 14 includes a plurality of finger sleeves 30. Each of the finger sleeves 30 is configured to receive a finger 32 or a thumb 34. Each of the finger sleeves 30 extends outwardly from the glove body 12 less than 1.5 inches. Each of the finger sleeves 30 has an open distal end 36 relative to the bottom end 16. The bottom end 16 has a cuff portion 38 that is configured for receiving a wrist.

A support rod 40 is releasably engaged to two of the finger sleeves 30 and extends forward out of the palm side 18. The support rod 40 is configured to partially extend around a weight lifting bar 26. The support rod 40 includes a hook portion 42 that extends forward out of the palm side and has an arcuate upper surface such that the hook portion 42 forms a receiving space 44 for the weightlifting bar 26. A grip portion 46 is attached to a connecting member 48 and the connecting member 48 is attached to the hook portion 42. The connecting member 48 extends between the finger sleeves 30 defining a middle finger sleeve and a ring finger sleeve. The grip portion 46 includes a first holding member 50 and a second holding member 52 that is attached to the connecting member 48 and positioned on opposite and lateral sides of the connecting member 48 such that the connecting member 48 is between the first holding member 50 and the second holding member 52. The first holding member 50 and the second holding member 52 form at least a partial ring for receiving the middle finger sleeve and ring finger sleeves such that the hook portion 42 extends outwardly from the palm side 18 of the glove body 12 wherein the hook portion 42 assist in supporting the weight of the weight lifting bar. The support rod 40 may comprise of metal, plastic, carbon fiber but may be any load bearing material.

In use, the weightlifting glove 12 is used conventionally as a glove and positioned on a hand. The support rod 40 is positioned over the glove body 12 such that the first holding member 50 and second holding member 52 are positioned around the middle finger sleeve and the ring finger sleeve of the glove 12. The hook portion 42 extends outwardly from the palm side 18. The receiving space 44 is positioned around the weightlifting bar to releasably secure the support rod 40 to the weightlifting bar 26. The weightlifter may then lift the weightlifting bar 26 using the hook portion 42 to support the weightlifting bar 26 wherein the thumb 34 of the weightlifter may be positioned in the conventional position, with the thumb 34 around the weightlifting bar 26, or the optimal position, with the thumb 34 behind the weightlifting bar 26. In the conventional position the weightlifter has to stabilize the weightlifting bar 26 in addition to applying force to lift the weightlifting bar 26. In the optimal position, the support rod 40 secures and stabilizes the weightlifting bar 26 to allow the weightlifter to exert more energy to lift the weightlifting bar 26 and less energy on stabilizing the weightlifting bar 26; thus, the support rod 40 allows the weightlifter to more safely lift a heavier weight. The padding 28 of the glove reduces discomfort of lifting weight with the support rod 40 between two fingers 32.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A weightlifting glove and hook combination assembly configured for assisting a person lifting a weight, said combination assembly comprising:

a glove body having a top end, a bottom end, a palm side, an outer surface and an inner surface, said top end and said bottom end being positioned on opposite ends of said glove body such that said glove body is positioned between said top end and said bottom end, a padding being attached to and covering said inner surface, said top end including a plurality of finger sleeves, said bottom end having a cuff portion being configured for receiving a wrist; and a support rod releasably engaging two of said finger sleeves and extending forward of said palm side, said support rod being configured to partially extend around a weightlifting bar, said support rod including a hook portion extending forward of said palm side and having an arcuate upper surface such that said hook portion forms a receiving space for said weightlifting bar, said support rod includes a grip portion being attached to a connecting member and said connecting member being attached to said hook portion, said connecting member extending between said finger sleeves defining a middle finger sleeve and a ring finger sleeve, said grip portion includes a first holding member and a second holding member being attached to said connecting member and positioned on opposite and lateral sides of said connecting member such that said connecting member is between said first holding member and said second holding member, each of said first holding member and said second holding members having a respective arcuate surface terminating in a free distal end relative to said connecting member and pointing in a direction parallel to said connecting member whereby each of said first holding member and said second holding member forms a partial ring for receiving said middle finger sleeve and ring finger sleeve such that said hook portion extends outwardly from said palm side of said glove body and said first holding member and said second holding member have openings configured to allow direct contact between the weightlifting bar and the middle finger sleeve and the ring finger sleeve, wherein said hook portion assists in supporting the weight of said weightlifting bar such that said thumb is positionable behind said weightlifting bar wherein said support rod stabilizes said weightlifting bar during a lift.

2. The weightlifting glove and hook combination assembly of claim 1, wherein said padding comprises a resiliently compressible material.

3. The weightlifting glove and hook combination assembly of claim 1, wherein each of said finger sleeves is configured for receiving a finger or a thumb.

4. The weightlifting glove and hook combination assembly of claim 1, wherein each of said finger sleeves extends outwardly from said glove body less than 1.5 inches, each of said finger sleeves having an open distal end relative to said bottom end.

5. A weightlifting glove and hook combination assembly configured for assisting a person lifting a weight, said combination assembly comprising:

a glove body having a top end, a bottom end, a palm side, an outer surface and an inner surface, said top end and said bottom end being positioned on opposite ends of said glove body such that said glove body is positioned between said top end and said bottom end, a padding being attached to and covering said inner surface, said padding comprising a resiliently compressible material, said top end including a plurality of finger sleeves, each of said finger sleeves being configured for receiving a finger or a thumb, each of said finger sleeves extending outwardly from said glove body less than 1.5 inches, each of said finger sleeves having an open distal end relative to said bottom end, said bottom end having a cuff portion being configured for receiving a wrist; and a support rod releasably engaging two of said finger sleeves and extending forward of said palm side, said support rod being configured to partially extend around a weightlifting bar, said support rod including:

a hook portion extending forward of said palm side and having an arcuate upper surface such that said hook portion forms a receiving space for said weightlifting bar;

a grip portion being attached to a connecting member and said connecting member being attached to said hook portion, said connecting member extending between said finger sleeves defining a middle finger sleeve and a ring finger sleeve, said grip portion including:

a first holding member and a second holding member being attached to said connecting member and positioned on opposite and lateral sides of said connecting member such that said connecting member is between said first holding member and said second holding member, each of said first holding member and said second holding members having a respective arcuate surface terminating in a free distal end relative to said connecting member and pointing in a direction parallel to said connecting member whereby each of said first holding member and said second holding member forms a partial ring for receiving said middle finger sleeve and ring finger sleeve such that said hook portion extends outwardly from said palm side of said glove body and said first holding member and said second holding member have openings configured to allow direct contact between the weightlifting bar and the middle finger sleeve and the ring finger sleeve, wherein said hook portion assists in supporting the weight of said weightlifting bar such that said thumb is positionable behind said weightlifting bar and said support rod stabilizes said weightlifting bar during a lift.

* * * * *